US010788245B2

(12) United States Patent
Hong et al.

(10) Patent No.: US 10,788,245 B2
(45) Date of Patent: Sep. 29, 2020

(54) REFRIGERANT RECOVERY PUMP WITH AN IMPROVED INPUT PORT

(71) Applicant: Fieldpiece Instruments, Inc., Orange, CA (US)

(72) Inventors: Tinggui Hong, Orange, CA (US); Jason Corbett Gilley, Orange, CA (US); David M. Hines, Santa Ana, CA (US)

(73) Assignee: Fieldpiece Instruments, Inc., Orange, CA (US)

( * ) Notice: Subject to any disclaimer, the term of this patent is extended or adjusted under 35 U.S.C. 154(b) by 43 days.

(21) Appl. No.: 15/883,559

(22) Filed: Jan. 30, 2018

(65) Prior Publication Data

US 2018/0216860 A1 Aug. 2, 2018

Related U.S. Application Data

(60) Provisional application No. 62/452,195, filed on Jan. 30, 2017.

(51) Int. Cl.
*F25B 45/00* (2006.01)
*F25B 41/04* (2006.01)

(52) U.S. Cl.
CPC ..... *F25B 45/00* (2013.01); *F25B 41/04* (2013.01); *F25B 2345/002* (2013.01); *F25B 2345/003* (2013.01); *F25B 2345/006* (2013.01); *F25B 2345/0051* (2013.01)

(58) Field of Classification Search
None
See application file for complete search history.

(56) References Cited

U.S. PATENT DOCUMENTS 5,235,821 A * 8/1993 Sevrain ..... B60H 1/00585 417/32
2004/0123622 A1* 7/2004 Yuzawa ..... F25B 45/00 62/475
2005/0257830 A1* 11/2005 Nonnie ..... F16K 31/26 137/179
2019/0093930 A1* 3/2019 McMasters ..... F25B 43/003

* cited by examiner

*Primary Examiner* — Edward F Landrum
*Assistant Examiner* — Daniel C Comings
(74) *Attorney, Agent, or Firm* — Paul J. Backofen, Esq.

(57) ABSTRACT

A refrigerant recovery system includes a direct current (DC) motor and digital display and controls enabling an automatic self-test mode to insure proper operation prior to starting to service an HVAC system and a maintenance assist mode to diagnose and suggest maintenance for optimum performance of the refrigerant recovery system.

6 Claims, 16 Drawing Sheets

REFRIGERANT RECOVERY PUMP WITH AN IMPROVED INPUT PORT

This application claims priority to U.S. Provisional Application 62/452,195, filed Jan. 30, 2017.

FIELD OF THE INVENTIONS

The inventions described below relate to the field of refrigerant recovery devices for cooling systems.

BACKGROUND OF THE INVENTIONS

Servicing of heating, ventilation and air conditioning (HVAC) systems requires the recovery of the refrigerant charging the cooling system.

SUMMARY

The devices and methods described below provide for a refrigerant recovery system using a direct current (DC) motor and digital display and controls enabling an automatic self-test mode to insure proper operation prior to starting to service an HVAC system and a maintenance assist mode to diagnose and suggest maintenance for optimum performance of the refrigerant recovery system.

The refrigerant recovery system includes a locknut system on the input port to keep the nipple and filter screen secured to the input port as hoses are connected and disconnected from the input port nipple. The refrigerant recovery system also includes an integrated cable securing system to prevent a loose or hanging power cord to present a hazard.

DETAILED DESCRIPTION OF THE INVENTIONS

Figure 1:
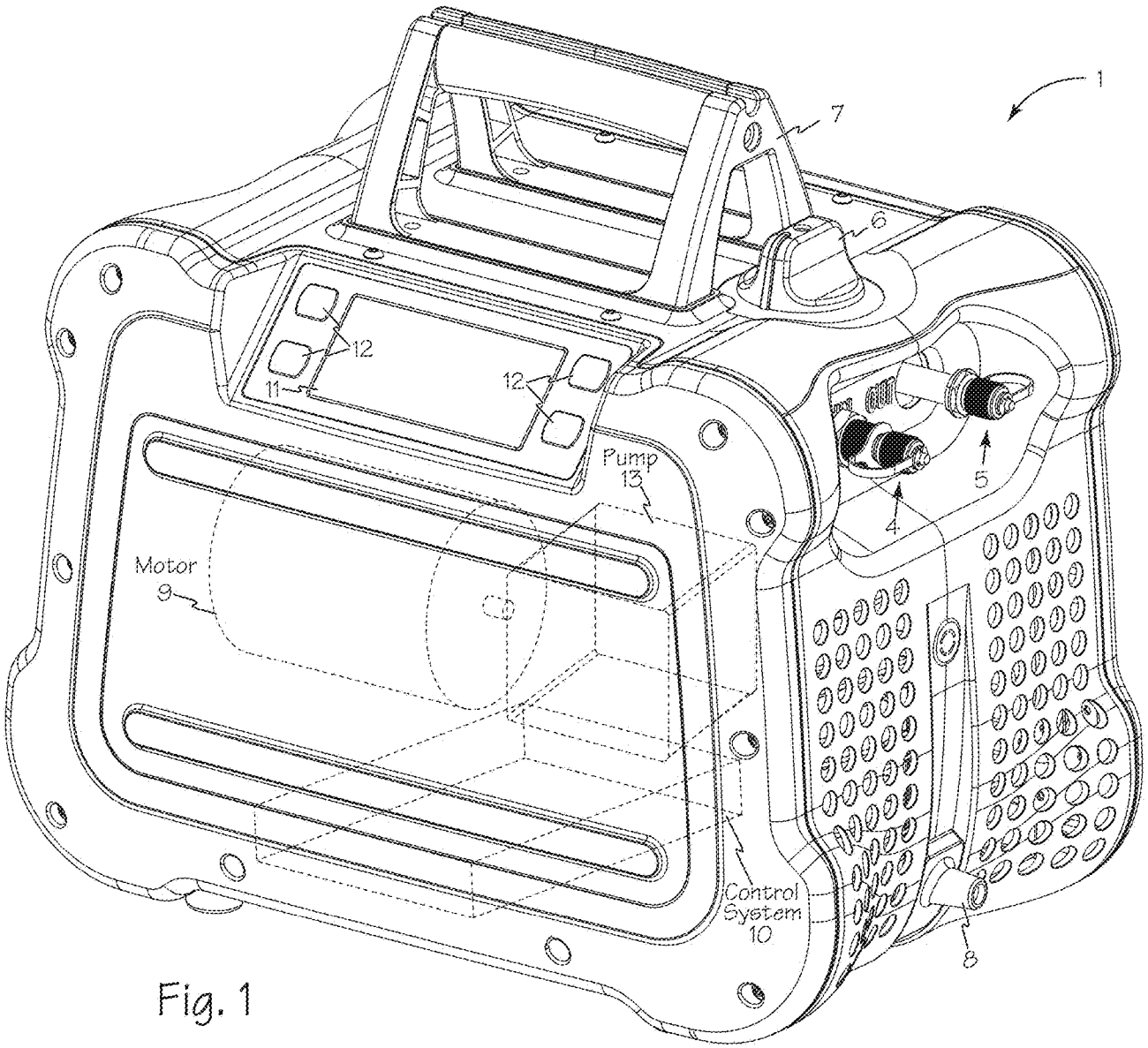
FIG. 1 is a perspective view of a refrigerant recovery system.

FIG. 1 is a perspective view of refrigerant recovery system 1 which includes input port 4, output port 5, manual valve control 6, handle 7 and electrical power port 8. Refrigerant recovery system 1 also includes direct current (DC) motor 9, operably connected to pump 13 and digital control system 10. Digital control system 10 is operably connected to the DC motor and valve control 6 to automatically monitor and control refrigerant recovery system 1. Digital control system 10 is also operatively connected to display screen 11 and enables operator input using buttons or other devices such as buttons 12.

Figure 2:
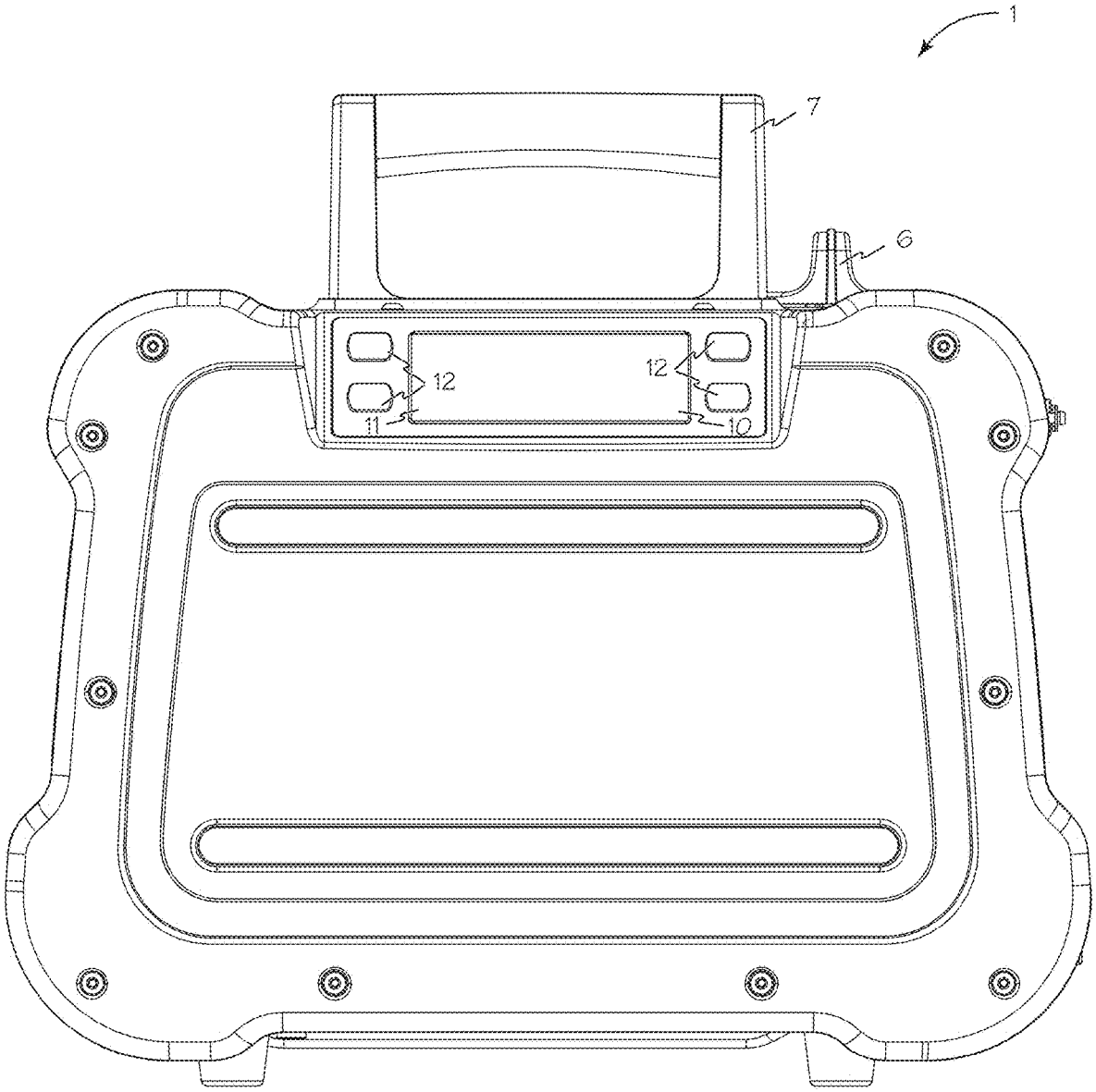
FIG. 2 is a front view of the refrigerant recovery system of FIG. 1.

FIG. 2 is a front view of the refrigerant recovery system of FIG. 1.

Figure 3:
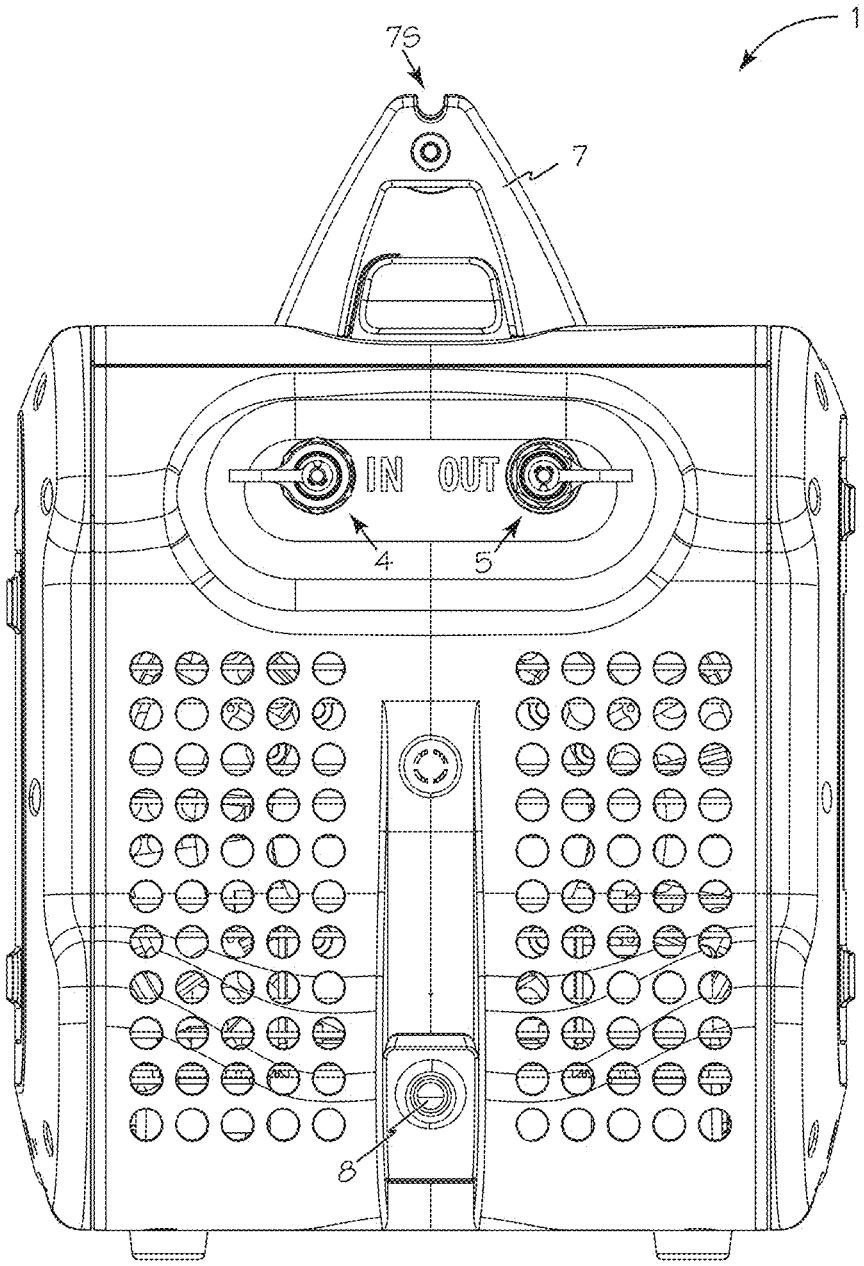
FIG. 3 is a right side view of the refrigerant recovery system of FIG. 1.

FIG. 3 is a right side view of the refrigerant recovery system of FIG. 1.

Figure 4:
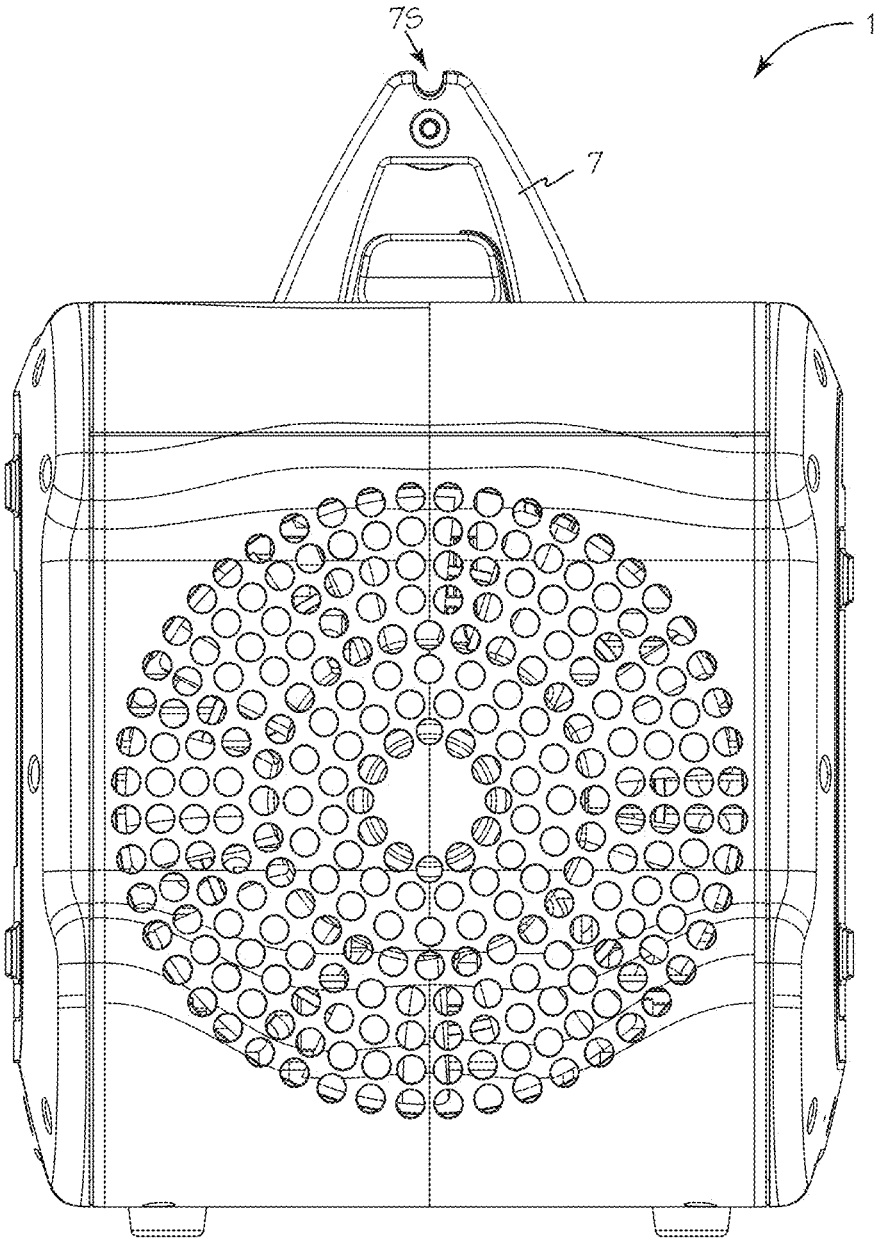
FIG. 4 is a left side view of the refrigerant recovery system of FIG. 1.

FIG. 4 is a left side view of the refrigerant recovery system of FIG. 1.

Figure 5:
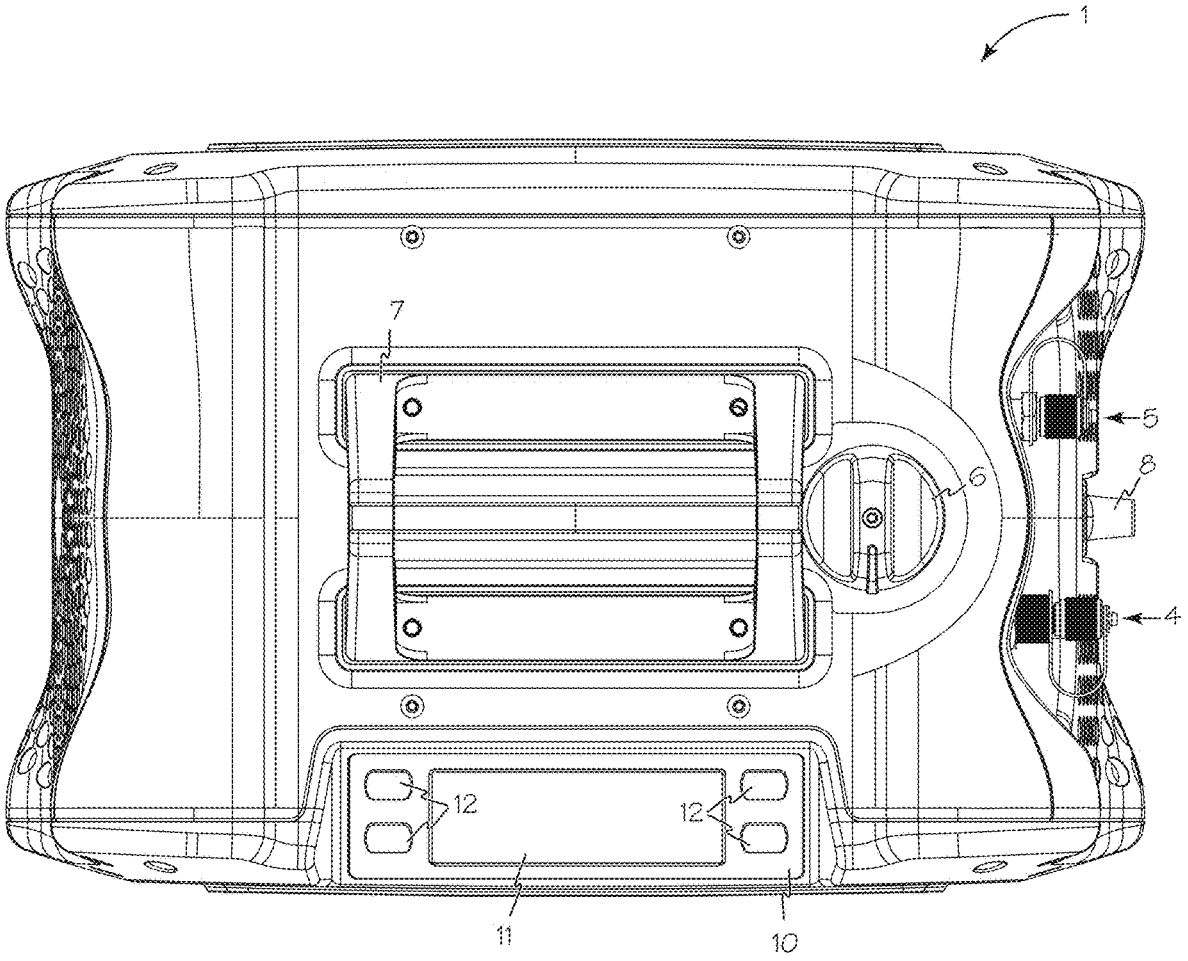
FIG. 5 is a top view of the refrigerant recovery system of FIG. 1.

FIG. 5 is a top view of the refrigerant recovery system of FIG. 1.

Figure 6:
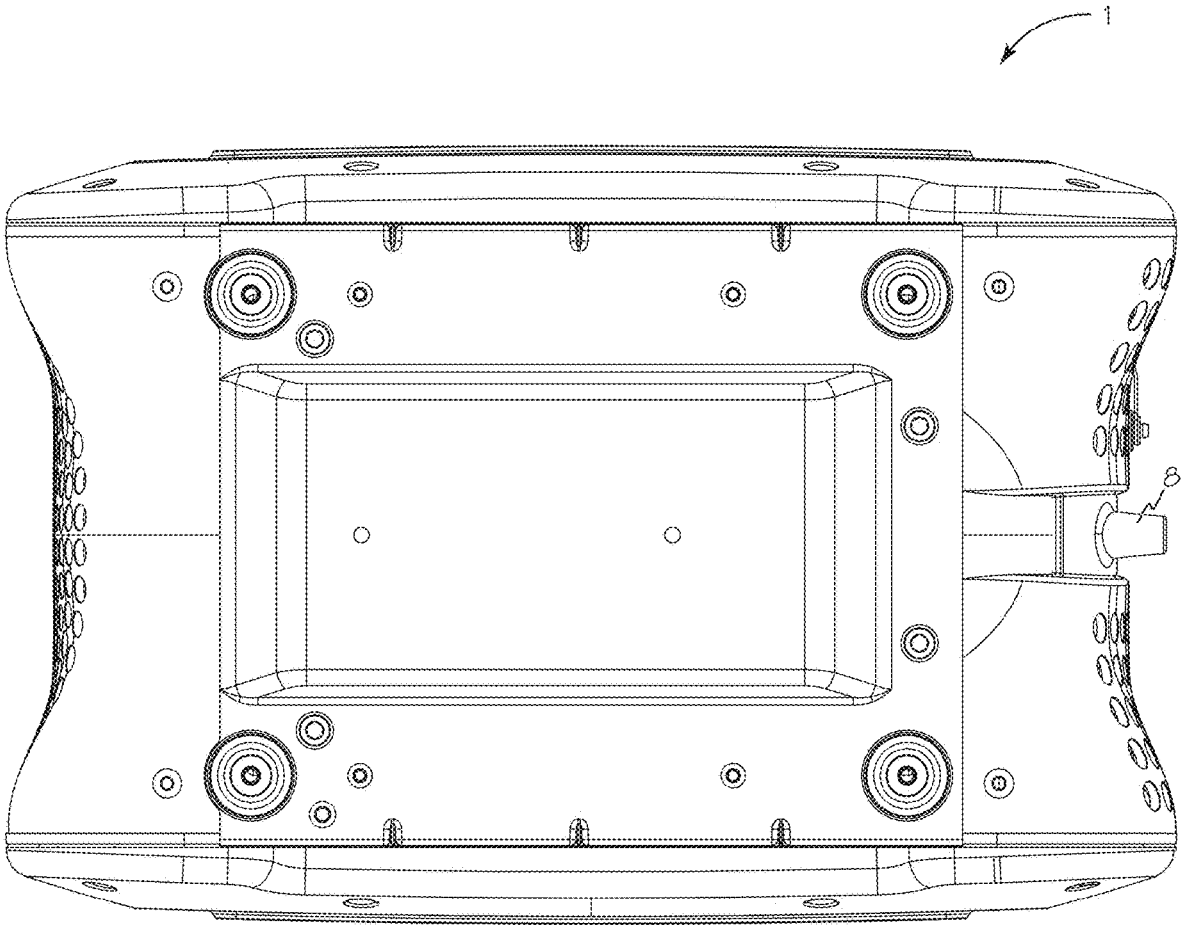
FIG. 6 is a bottom view of the refrigerant recovery system of FIG. 1.

FIG. 6 is a bottom view of the refrigerant recovery system of FIG. 1.

Figure 7:
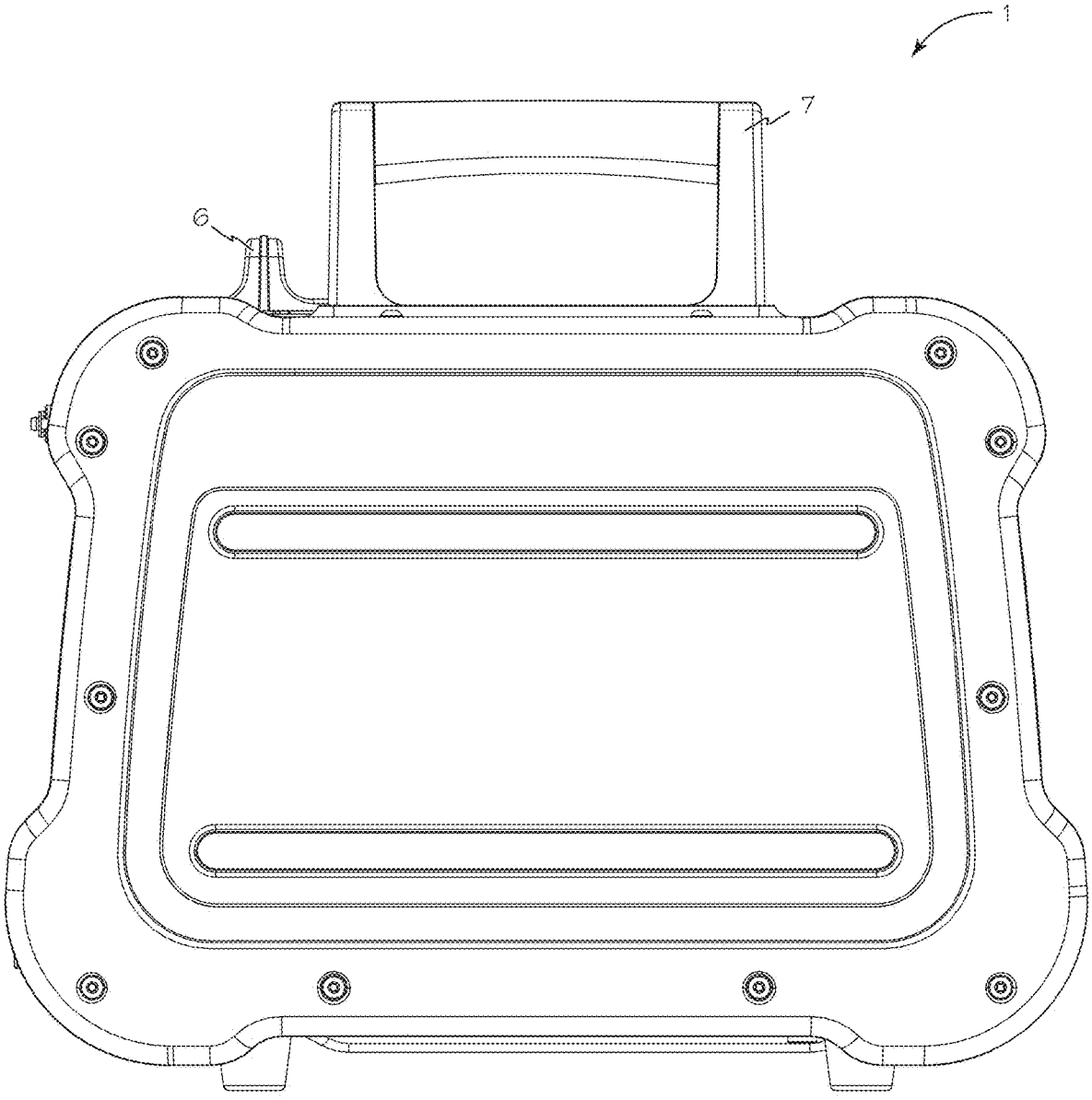
FIG. 7 is a back view of the refrigerant recovery system of FIG. 1.

FIG. 7 is a back view of the refrigerant recovery system of FIG. 1.

Figure 8:
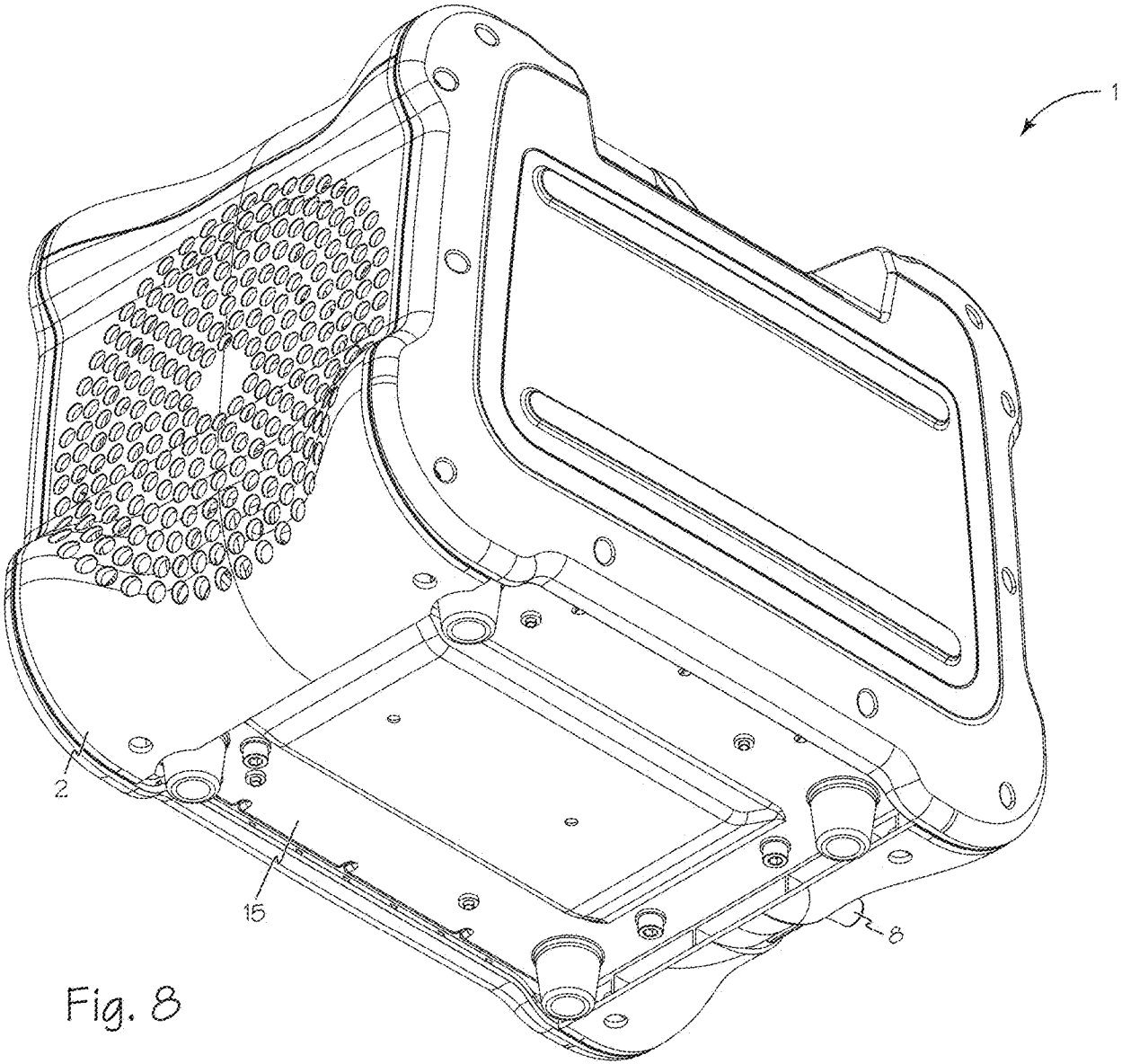
FIG. 8 is a bottom-left perspective view of the refrigerant recovery system of FIG. 1.

FIG. 8 is a bottom-left perspective view of the refrigerant recovery system of FIG. 1. Housing 2 is sized and configured to encompass the operating components of refrigerant recovery system 1 which are secured to base plate/chassis 15.

Figure 9:
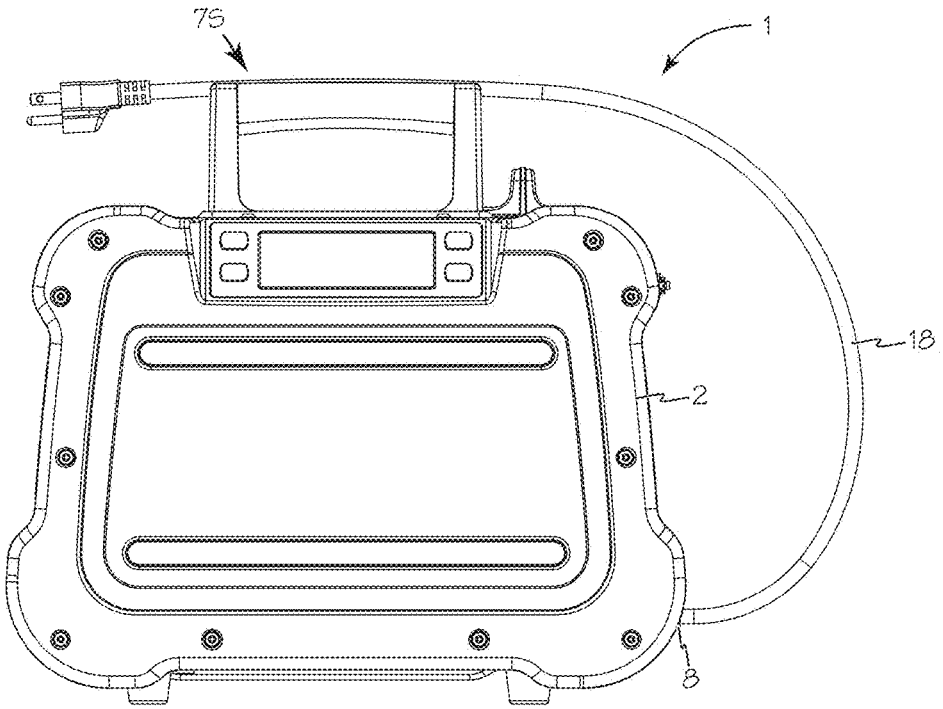
FIG. 9 is a front view of the refrigerant recovery system of FIG. 1 showing the cord storage.

FIG. 9 is a front view of the refrigerant recovery system of FIG. 1 illustrating cord storage using cord slot 7S. Power cord 18 emerges from housing 2 through power port 8 and engages cord slot 7S.

Figure 10:
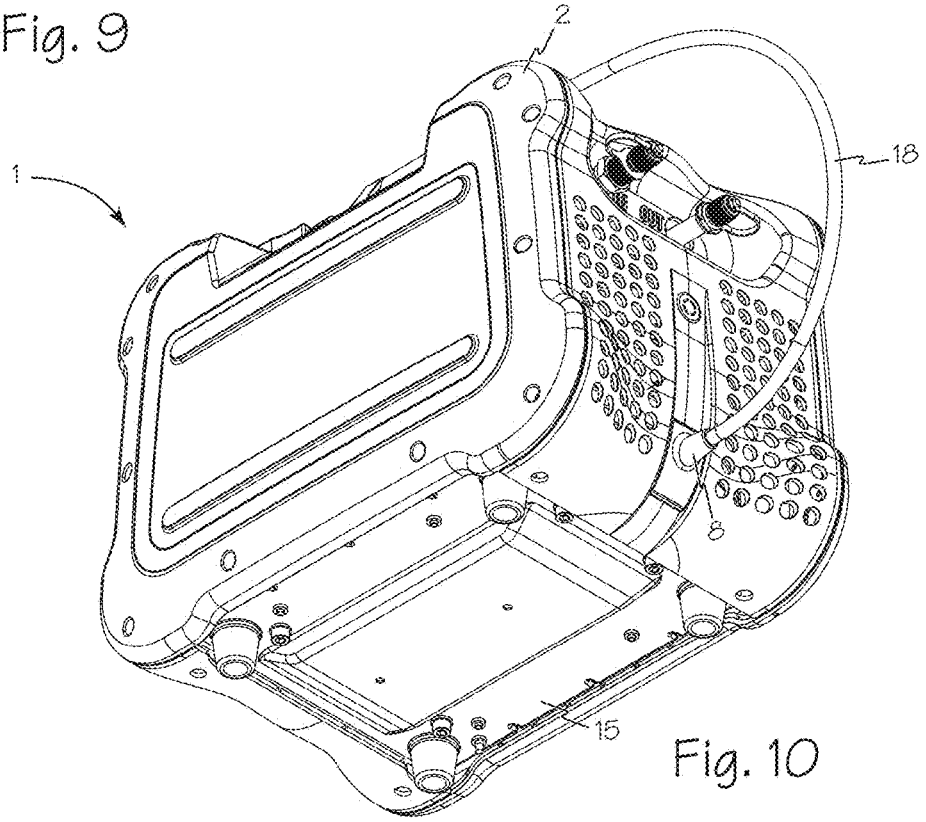
FIG. 10 is a bottom-right perspective view of the refrigerant recovery system showing cord storage of FIG. 9.
Figure 12:
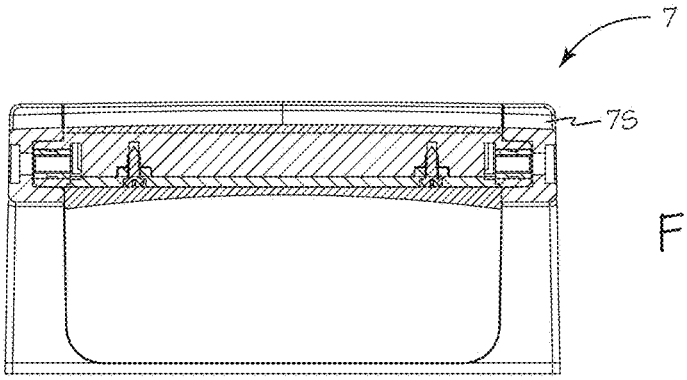
FIG. 12 is a section view of the handle of FIG. 11 taken along A-A.
Figure 11:
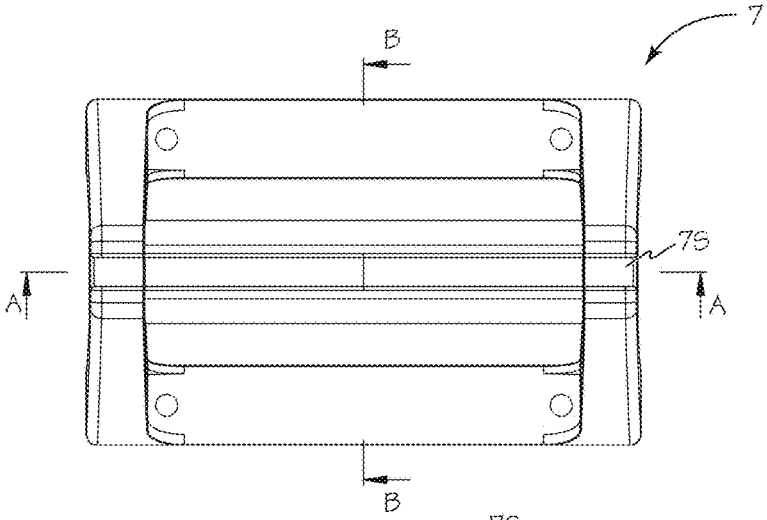
FIG. 11 is a top view of the handle for the refrigerant recovery system with cord storage.
Figure 13:
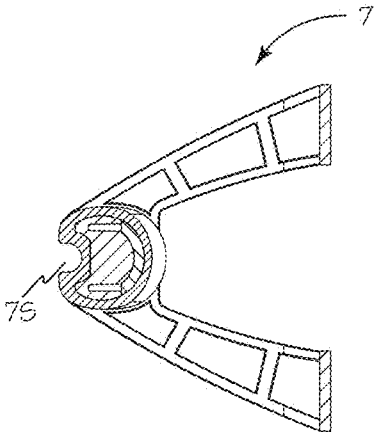
FIG. 13 is a section view of the handle of FIG. 11 taken along B-B.
Figure 14:
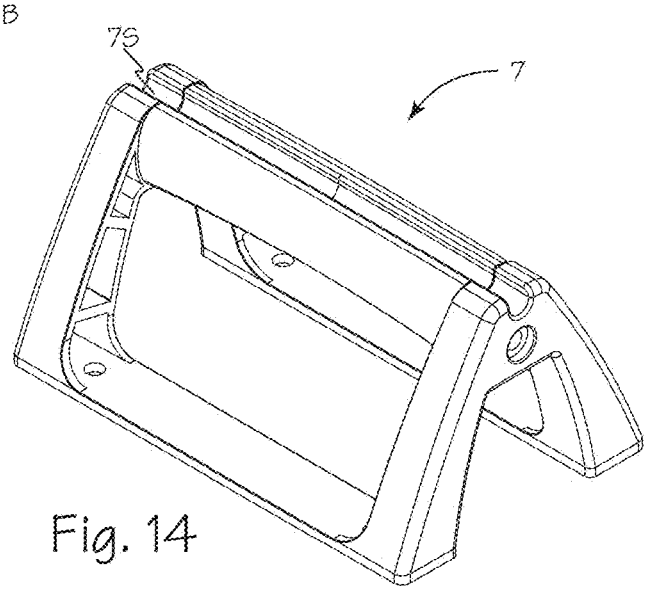
FIG. 14 is a perspective view of the handle of FIG. 11.

FIG. 10 is a bottom-right perspective view of the refrigerant recovery system of FIG. 9.

FIGS. 11, 12, 13 and 14 are close-up views of handle 7. Cord slot 7 is sized and configured to frictionally engage power cord 18.

Figure 15:
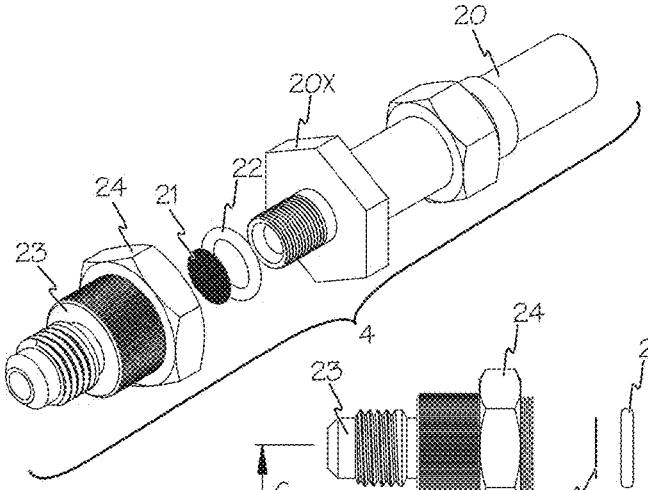
FIG. 15 is an exploded perspective view of the components of the input port.
Figure 16:
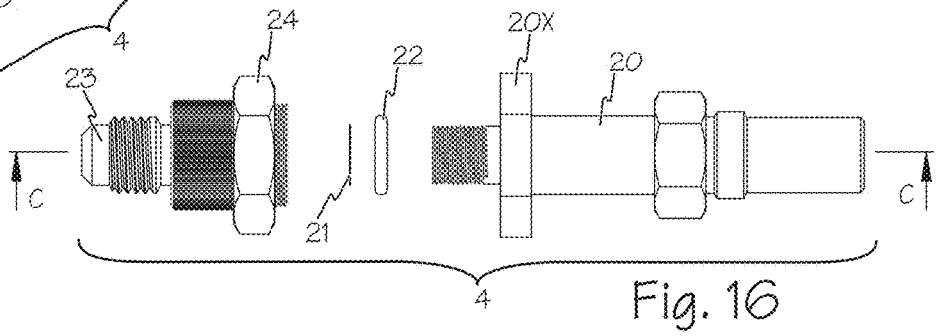
FIG. 16 is an exploded side view of the components of the input port.
Figure 17:
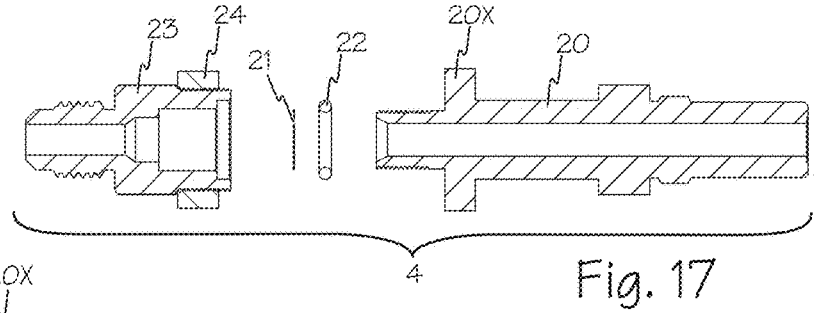
FIG. 17 is a section view of the components of the exploded input port of FIG. 16 taken along C-C.

FIGS. 15, 16 and 17 are exploded close-up views of components of input port 4 of refrigerant recovery system 1. Input port 4 is operably connected to pump 13 and includes input connector 20 and mesh filter 21 to prevent contaminants from entering input connector and damaging the pump or the recovery system. Mesh filter 21 and O-ring 22 secured between the input connector 20 and input nipple 23. In the course of regular use, users are routinely attaching and removing hoses from the input nipple which generally results in the nipple coming loose from the input port and leaking or falling off and losing the mesh screen and or the O-ring.

Figure 18:
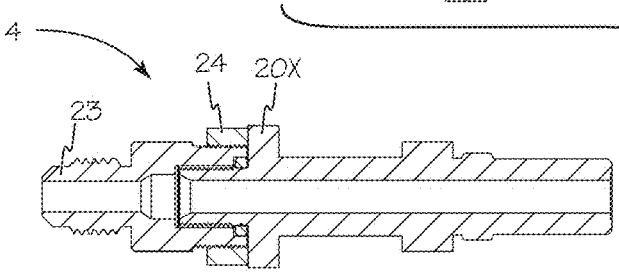
FIG. 18 is a section view of the input port of FIG. 16 showing the locking nut engaged.
Figure 19:
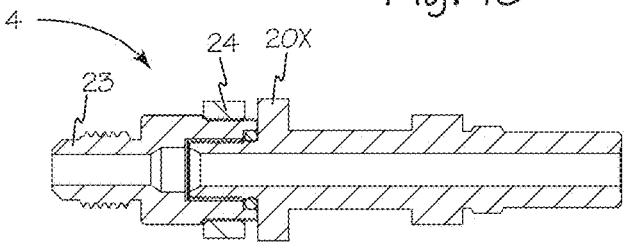
FIG. 19 is a section view of the input port of FIG. 16 showing the locking nut disengaged.

Input connector 20 includes shoulder 20X. Lock nut 24 engages exterior threads on input nipple 23. When input nipple 23 fully engages input connector 20, lock nut 24 is rotated until it frictionally engages shoulder 20X to lock input nipple 23 to input connector 20 as illustrated in FIG. 18. Input connector 20, mesh filter 21 and O-ring 22 may be serviced or replaced by disengaging lock nut 24 from shoulder 20X as illustrated in FIG. 19. Once the lock nut is disengaged, input nipple 23 may be disengaged from input connector 20.

Figure 20:
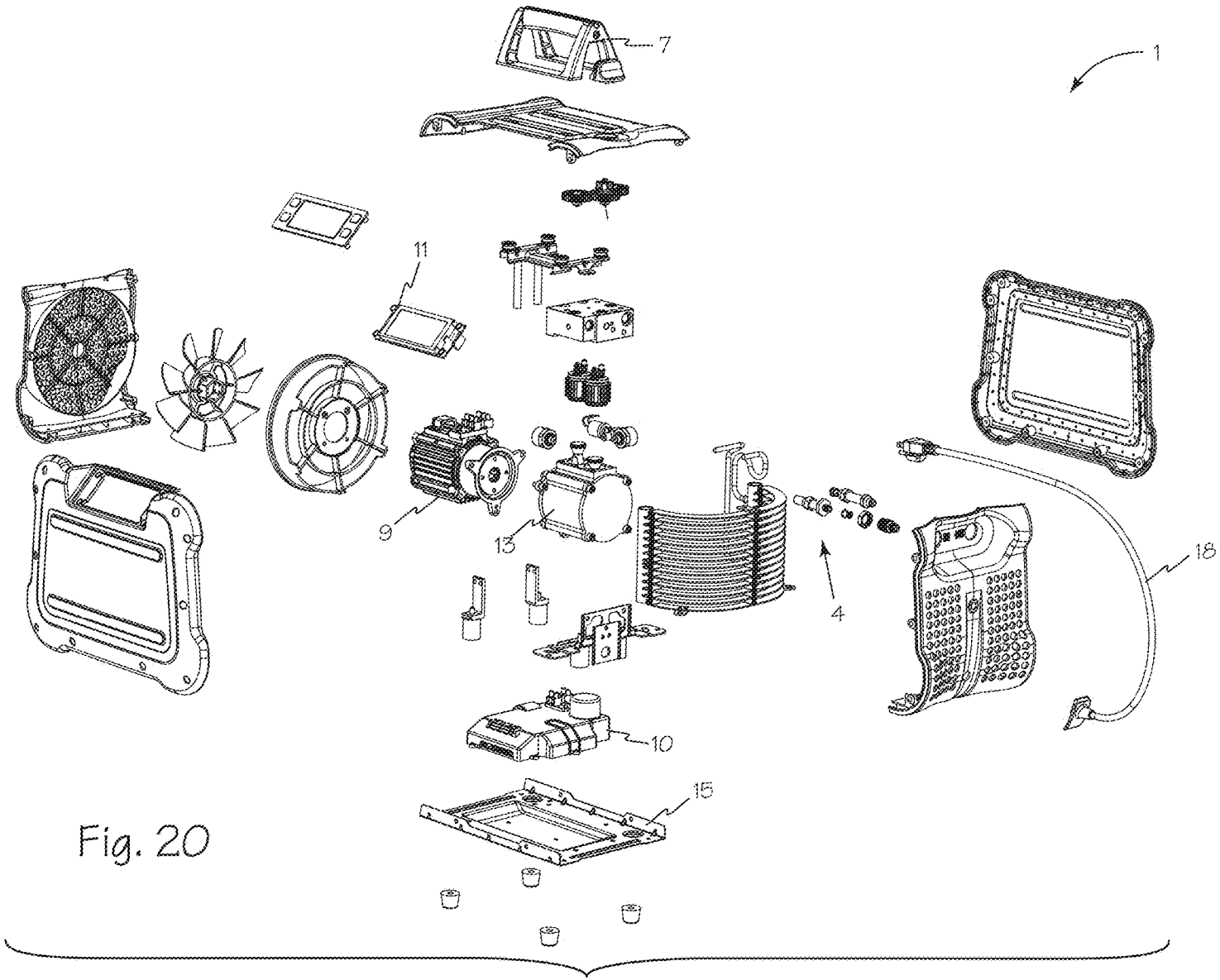
FIG. 20 is an exploded view of the refrigerant recovery system of FIG. 1.

FIG. 20 is an exploded view of refrigerant recovery system 1.

Figure 21:
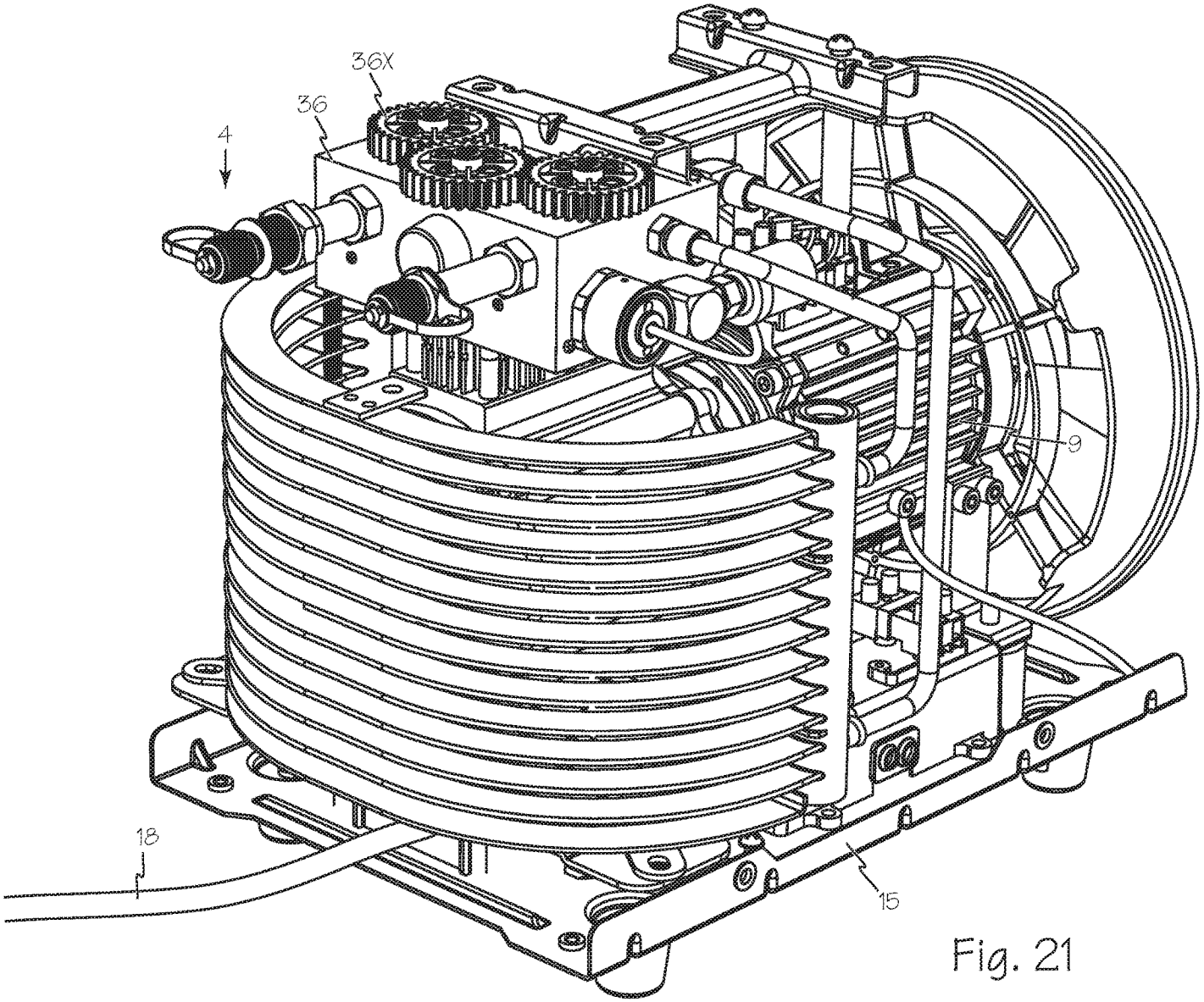
FIG. 21 is a perspective view of the internal components of refrigerant recovery system of FIG. 1.

FIG. 21 is a perspective view of the internal components of refrigerant recovery system of FIG. 1 illustrating valve housing 30 and connecting gears 30X that engage manual valve control 6 which controls the operation of pump 13.

Figure 22:
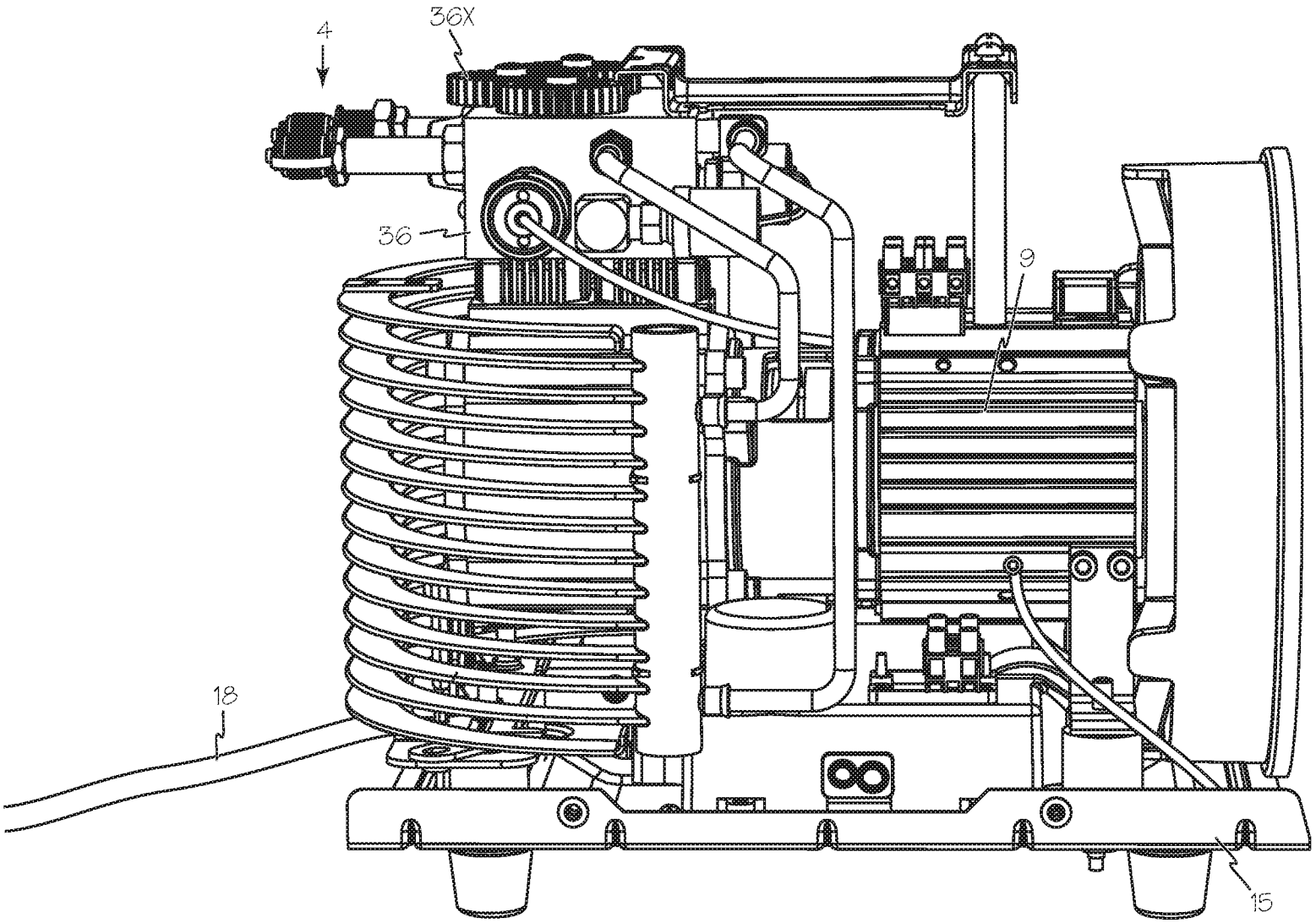
FIG. 22 is a side view of view of the internal components of refrigerant recovery system of FIG. 1.

FIG. 22 is a side view of view of the internal components of refrigerant recovery system of FIG. 1.

Figure 23:
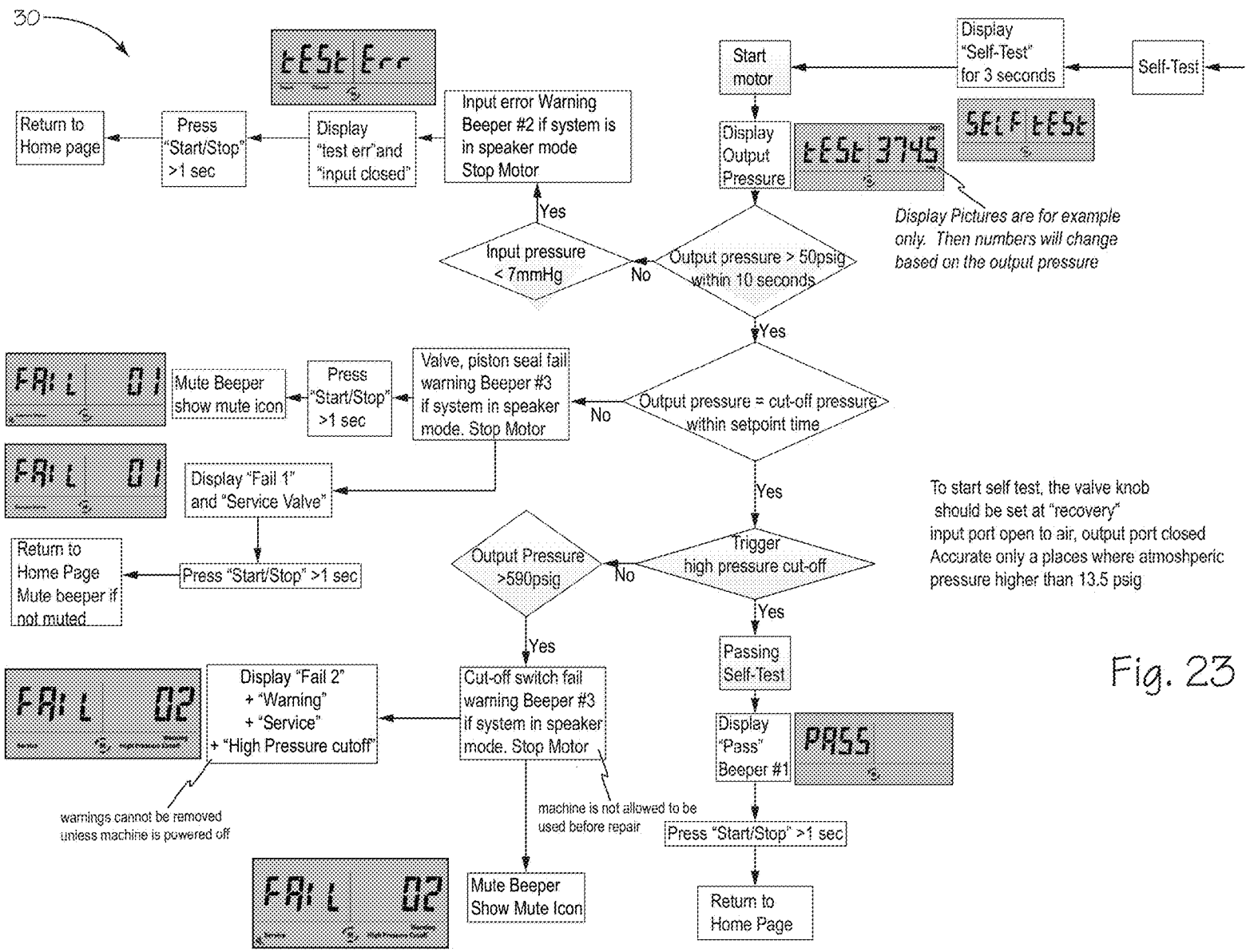
FIG. 23 is a flow chart of the self-test system.

FIG. 23 is a flow chart of self-test mode 31. Self-test mode 31 is an automatic self-test algorithm that exists in digital control system 10 and provides instructions to the digital control system to insure proper operation prior to starting to service an HVAC system.

Figure 24:
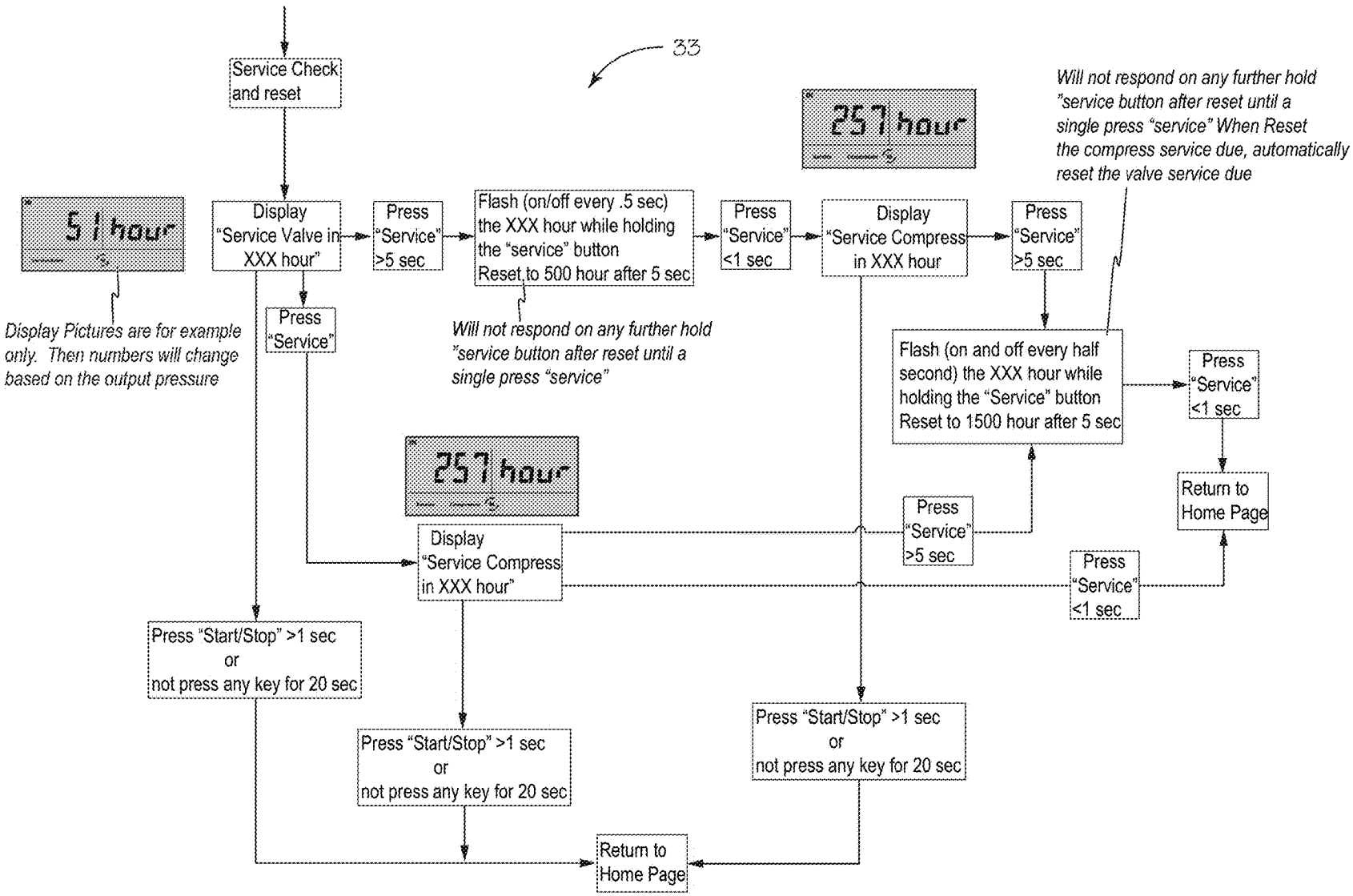
FIG. 24 is a flow chart of the maintenance assistant system.

FIG. 24 is a flow chart of maintenance assistant mode 33. Maintenance assist mode 33 is an automatic algorithm that exists in digital control system 10 and provides instructions to the digital control system to diagnose and suggest maintenance for optimum performance of the refrigerant recovery system.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

We claim:

1. A refrigerant recovery system comprising:

a direct current (DC) motor;

a refrigerant pump operably connected to the DC motor, the refrigerant pump having at least an input port and an output port;

an input connector with a shoulder, the input connector operably engaged to the input port;

an input nipple having a lock nut, the input nipple operably engaged to the input connector with the lock nut oriented to frictionally engage the input connector shoulder; and a mesh filter and an O-ring secured between the input nipple and the input connector.

2. The refrigerant recovery system of claim 1 further comprising:

a valve control operably connected to the refrigerant pump.

3. The refrigerant recovery system of claim 1 further comprising:

a valve control operably connected to the refrigerant pump; and a digital control system operably connected to the DC motor and valve control to automatically monitor and control the refrigerant recovery system.

4. The refrigerant recovery system of claim 3 wherein the digital control system further comprises:

a self-test algorithm to provide instructions to the digital control system to insure proper operation prior to starting to service an HVAC system.

5. The refrigerant recovery system of claim 3 wherein the digital control system further comprises:

a maintenance assist algorithm operable to provide instructions to the digital control system to diagnose and suggest maintenance for optimum performance of the refrigerant recovery system.

6. The refrigerant recovery system of claim 3 wherein the digital control system further comprises:

a self-test algorithm to provide instructions to the digital control system to insure proper operation prior to starting to service an HVAC system; and a self-test algorithm operable to provide instructions to the digital control system to diagnose and suggest maintenance for optimum performance of the refrigerant recovery system.

* * * * *